United States Patent [19]

Dawes et al.

[11] Patent Number: 4,710,238

[45] Date of Patent: Dec. 1, 1987

[54] MAKING OF STEEL COMPONENT

[75] Inventors: Cyril Dawes, Sutton Coldfield; Donald F. Tranter, Evesham, both of England

[73] Assignee: Lucas Industries Public Limited Company, Birmingham, England

[21] Appl. No.: 825,890

[22] Filed: Feb. 4, 1986

[30] Foreign Application Priority Data

Feb. 20, 1985 [GB] United Kingdom ..... 8504349

[51] Int. Cl.[4] ..... C21D 1/74

[52] U.S. Cl. ..... 148/16.6; 148/16.5; 148/318; 148/319

[58] Field of Search ..... 148/16.5, 16.6, 16, 148/31.5, 6.35

[56] References Cited

U.S. PATENT DOCUMENTS 4,496,401 1/1985 Dawes et al. ..... 148/16.6

FOREIGN PATENT DOCUMENTS 1813808 12/1968 Fed. Rep. of Germany .
2135763 7/1971 Fed. Rep. of Germany .
2179879 11/1973 France .
2286195 4/1976 France .
2027062 2/1980 United Kingdom .

OTHER PUBLICATIONS

Härterei-Technische Mitteilungen, vol. 29, #1, 3/74, pp. 42–49.

Patents Abstracts of Japan, vol. 8, #56 (C-214), (1493), Mar. 14, 1984.

Chemical Abstracts, vol. 89, #24, Dec. 1978, p. 230, Abstract #20141d, Cols, Ohio, J. Bidlen, "Effect of Nitridation . . . ".

Chemical Abstracts, vol. 67, 1967, p. 8794, Abstract #93222v, Columbus, Ohio.

*Primary Examiner*—R. Dean

*Attorney, Agent, or Firm*—Nixon & Vanderhye

[57] ABSTRACT

A component formed of interstitial free steel is heated in a gaseous atmosphere containing 15% by volume of a nitrogen doner, e.g. ammonia, at about 500° C. to about 740° C. for about 30 minutes to about 4 hours to form an epsilon iron nitride surface layer, and a layer of nitrides of trace alloying elements below the surface layer.

11 Claims, 1 Drawing Figure

MAKING OF STEEL COMPONENT

Figure 1:
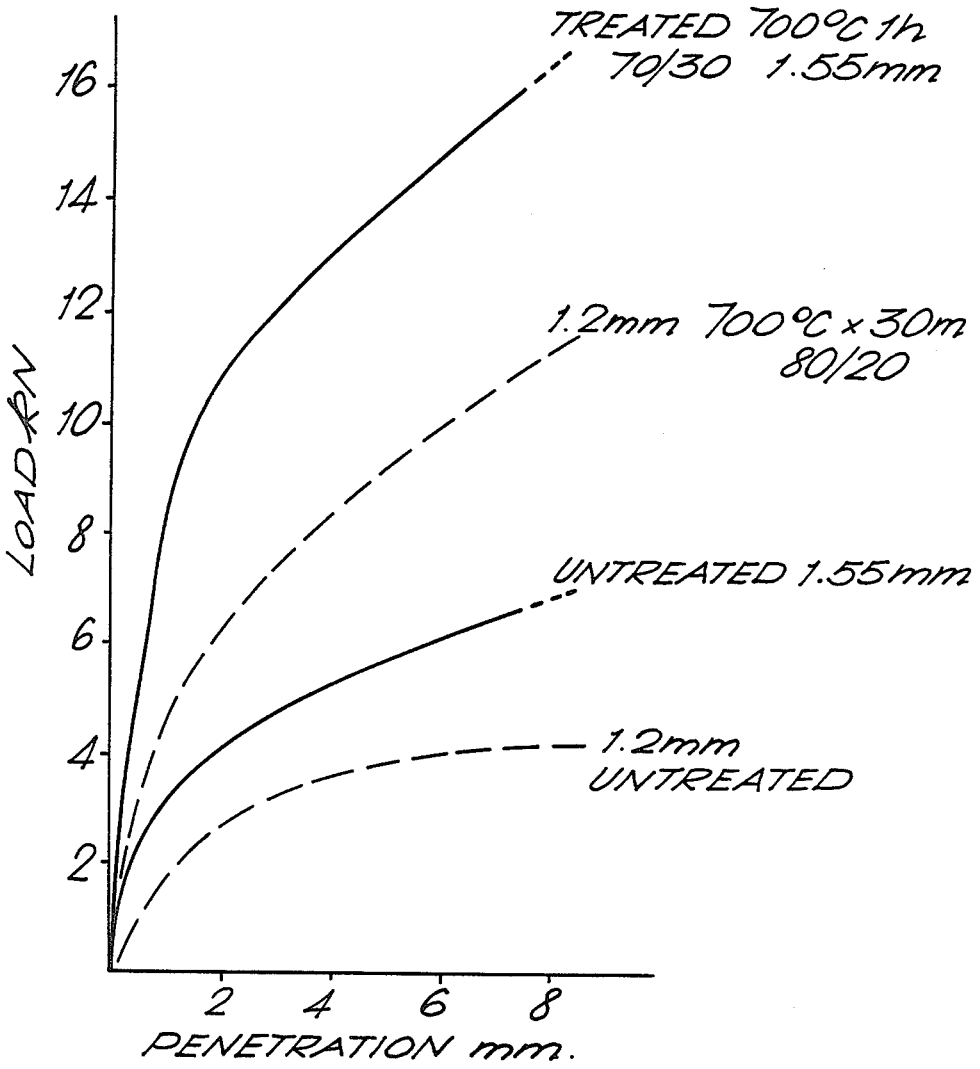

The invention relates to a method of making a steel component having predetermined properties, in particular a permutation of low weight, corrosion resistance and tribological properties and, according to need, yield strength, black colour and other properties. The invention also includes the component itself.

It is known from our European Patent publication No. 0077627A published April 1983 to subject a non alloy steel component to treatment in a nitriding gaseous atmosphere at elevated temperature to produce an epsilon iron nitride surface layer thereon and then form on top an oxide-rich surface layer. The components in question may be engineering components of the type used in automotive and other industries. The component is formed of a non-alloy steel, especially one having a low carbon content. It is also known from our European Patent publication No. 0058278 to form an ultra lightweight link component of low carbon steel for a windscreen wiper and provide the component with an epsilon iron nitride surface layer. The entire disclosure of each of these prior documents is incorporated herein merely by this reference.

It is known that interstitial free steel is of increased formability which makes it a candidate for use in making components. Such steel is prone to brittleness when subjected to nitriding. This invention is based on the realisation that, under certain nitriding processes, such a steel may be treated to secure the benefits of nitriding without inducing brittleness.

According to one aspect of the invention there is provided a method of making a non-brittle component of interstitial-free steel, the component having a thickness of at least 0.5 mm, the method comprising heating the component in a gaseous atmosphere containing a nitrogen donor, the concentration of the donor being sufficient to provide the component with both an epsilon iron nitride surface layer and a layer of nitrides of trace alloying elements below the surface layer, the heat treatment being performed at a temperature of from about 500° C. and for a period of from about 30 minutes.

According to another more specific aspect of the invention there is provided a method of making a non-brittle component of interstitial-free steel, the component having a thickness of at least 0.5 mm, the method comprising heating the component in a gaseous atmosphere containing a nitrogen donor, the concentration of the donor being sufficient to provide the component with both an epsilon iron nitride surface layer and a layer of nitrides of trace alloying elements, particularly titanium, below the surface layer, the heat treatment being performed at a temperature of from about 500° C. to about 740° C. and for a period of from about 30 minutes to about four hours.

It is a key feature of the invention that the conditions of the nitriding are arranged to cause the formation of an epsilon iron nitride surface layer and beneath it a layer of a fine dispersion of nitrides of alloying elements in the interstitial-free steel. The conditions are determined by the proportion of the nitrogen donor, typically ammonia, in the gaseous atmosphere and the temperature and time of the treatment. If the proportion of the nitrogen donor is less than 15% of the atmosphere, dependent on treatment temperature, the nitrogen will diffuse through the component and the required epsilon iron nitride surface layer will not be formed and the required tribological and corrosion resistance properties will not be achieved. It is preferred that the concentration of ammonia be at least 20%, preferably 50%, or more by volume, of the atmosphere. Where the atmosphere is a mixture of ammonia and another gas, it is preferred to use an atmosphere of ammonia and endothemic gas, ammonia and exothermic gas or ammonia and nitrogen, with the optional inclusion of at least one of carbon dioxide, carbon monoxide, air, water vapour and methane. It is much preferred that the atmosphere be a 20:80 or 50:50 by volume mixture of ammonia and an endothermic gas mixture of carbon monoxide, carbon dioxide, nitrogen and hydrogen.

The nitriding step is carried out at elevated temperature. This must be at least 500° C.; if the temperature is less than this, the nitriding step will take too long to be practical on an economic scale. The temperature should not exceed 740° C. otherwise the component will have inadequate strength and will be prone to distortion.

The nitriding step will require to be performed for a period which is industrially acceptable and will of course form a layer of the required properties. This period will typically range from about 30 minutes (or less depending on the equipment used) up to about four hours; preferably the period is about one hour.

The steel to be treated in the invention is so-called interstitial-free steel This is a steel which has been vacuum degassed so that it has virtually no soluble carbon or nitrogen. Typically it contains small amounts of titanium, aluminium and columbium. It has an average plastic strain ratio of 2.0. The nitriding of an interstitial-free steel causes ferrite strengthening and nitride precipitation of the trace alloying elements. This results in the development of increased depth of hardness with increasing treatment time and improved resistance to tempering. It was to be expected that brittleness would also be induced but by this invention surprisingly this does not happen. Instead, as a result of the nitriding step, the steel has an epsilon iron nitride surface layer which may range from about 10 to about 50 micrometers in thickness. Below this is a layer of nitrided alloying elements, particularly titanium. The innermost portion of the component is free of nitrided elements, and we believe that as a consequence of these layers at the periphery of the component but not within its centre, the component will not be brittle.

Viewed from another aspect, the invention provides a method of making a component of a steel by nitriding the component to form an epsilon iron nitride surface layer, optionally followed by the formation of an oxide rich layer and quenching *characterised in that* the component is formed of an interstitial-free steel which is nitrided in a gaseous atmosphere containing a nitrogen donor in sufficient quantity to form the epsilon iron nitride surface layer and an underlying layer of nitrides of the alloying elements of the interstitial-free steel, the innermost portion of the component being substantially free of nitrides whereby the component has corrosion resistance and tribological properties without brittleness.

The steel component is preferably from about 0.5 mm to about 3 mm thick, dependent on the properties required of the component. With an increase in component thickness, in the method the concentration of nitrogen donor should be increased together with the temperature and/or treatment time.

It is possible according to the invention to subject the component to further steps in addition to the nitriding step. For example, the component may be subjected to oxidation and/or quenching.

The oxidation step may be performed following nitriding while the component is still at high temperature by exposing the component to air or other oxidising atmosphere for at least two seconds. The oxide layer formed is preferably from about 0.2 micrometer to about 1 micrometer, preferably about 0.5 micrometer.

Quenching is preferably performed in an oil/water emulsion following nitriding and/or oxidation. The quenching tends to darken the colour of the component so that an aesthetically pleasing black finish is obtained.

According to another aspect of this invention, there is provided a non-brittle steel component formed of interstitial-free steel having a thickness of at least 0.5 mm, an epsilon iron nitride surface layer thereon, nitrides of alloying elements in the steel underlying the surface layer.

Because of the properties of a steel component of the invention the component finds utility in a wide range of industrial applications. For example, a component having a thickness of 1.5 mm and a yield strength of 800 MPa can be used as a car bumper armature since it will resist impact forces in a low speed collision. Where surface layer strength is required for example in a car seat slider up to 2 mm wall thickness, the product will have the required permutation of surface layer strength, corrosion resistance etc.

In order that the invention may be well understood it will now be described with reference to the following nonlimitative examples.

EXAMPLE I

A series of components of 1.2 mm thick interstitial-free steel having the following composition
C 0.018, S 0.012, Mn 0.21, P 0.01, and Ti 0.12
was subjected to nitriding, oxidising and quenching. The nitriding atmosphere in the heat treatment furnace, treatment time and temperature were varied as shown in Table I. The oxidation step was conducted by exposing the nitrided component to air for 15 seconds on removal from the heat treatment furnace, followed by quenching into a waterbased emulsion quenchant at 80° C. The quenchant was CASTROL VW553 in a ratio of 1 part quenchant:6 parts later.

Each component was then tested for its yield strength under a penetration load test, and the results shown in Table I were obtained. In this test a chisel edge punch is continuously pressed onto a surface of the components and any deformation or penetration which occurs is noted visually. Low penetration indicates brittleness. These results show that at a given temperature, an increase in treatment time can decrease yield strength and that for a higher treatment temperature at the same treatment time there is a significant increase in yield strength.

EXAMPLE II

Two sample components of different thicknesses were subjected to the load penetration test of Example I. Two parallel sample components were then subjected to the method of Example I under the conditions shown in the accompanying FIG. 1 and the treated components were then subjected to the load penetration test. The results obtained are shown in FIG. 1. These results show that when a component of interstitial free steel 1.2 mm thick was nitrided in a 20:80 ammonia:endotherm atmosphere at 700° C. for 30 minutes, the load required to cause the same penetration more than doubled. For a component 1.55 mm thick nitrided in a 30:70 ammonia:endotherm atmosphere at 700° C. for one hour, the same degree of improvement resulted

TABLE I

Load penetration test results for I.F. steel, 1.2 mm

| | Nitriding conditions | | | Results | |
|---|---|---|---|---|---|
| | Atmosphere | | treatment | penetration | |
| Sample | ammonia:endotherm ratio | treatment (°C.) | time (mins) | load (KN) | depth (mm) |
| 1 | 50:50 | 550 | 30 | 8 | 7 |
| 2 | 50:50 | 550 | 45 | 8.5 | 7 |
| 3 | 50:50 | 550 | 90 | 8.5 | 3.8 |
| 4 | 20:80 | 700 | 30 | 11.8 | 7.5 |

We claim:

1. A method of treating a component of steel by nitriding the component to form a epsilon iron nitride surface layer, the nitriding being carried out by heating the component in a gaseous atmosphere containing a nitrogen donor, the heat treatment being performed at a temperature of from about 500° C. to about 740° C. for a period of about 30 minutes to about 4 hours wherein (i) the component is formed of an interstitial-free steel and has a thickness of at least 0.5 mm, and (ii) the concentration of nitrogen donor in the gaseous atmosphere is sufficient to form the epsilon iron nitride surface layer and below the surface layer, a layer of nitrides of the trace alloy elements of the interstitial-free steel.

2. A method according to claim 1, wherein the proportion of the nitrogen donor in the gaseous atmosphere in which the component is heated is form about 15% to about 50% by volume.

3. A method according to claim 1, wherein the heat treatment is carried out so as to form in the component an epsilon iron nitride surface layer having a thickness of about from 10 micrometers to about 50 micrometers; an underlying layer of nitrided alloying elements and an innermost portion which is substantially free of nitrided elements.

4. A method according to claim 2, wherein the heat treatment is carried out so as to form in the component an epsilon iron nitride surface layer having a thickness of about from 10 micrometres to about 50 micrometers; an underlying layer of nitrided alloying elements and an innermost portion which is substantially free of nitrided elements.

5. A method according to claim 1, wherein the component is formed of an interstitial-free steel comprising a vacuum degassed steel which is free of soluble carbon and nitrogen and which contains small amounts of alloying elements selected form the group consisting of titanium, aluminum and columbium.

6. A method according to claim 2, wherein the component is formed of an interstitial-free steel comprising a vacuum degassed steel which is free of soluble carbon and nitrogen and which contains small amounts of alloying elements selected from the group consisting of titanium, aluminum and columbium.

7. A method according to claim 3, wherein the component is formed of an interstitial-free steel comprising a vacuum degassed steel which is free of soluble carbon and nitrogen and which contains small amounts of alloying elements selected from the group consisting of titanium, aluminum and columbium.

8. A method according to claim 4, wherein the component is formed of an interstitial-free steel comprising the vacuum degassed steel which is free of soluble carbon and nitrogen and which contains small amounts of alloying elements selected from the group consisting of titanium, aluninium and columbium.

9. A steel component having an epsilon iron nitride surface layer wherein the component is formed of an interstitial-free steel having a thickness of at least 0.5 mm, and there is present an underlying layer of nitrides of the alloying elements of the interstitial-free steel, the innermost portion of the component being substantially free of nitrides whereby the component has corrosion resistance and tribological properties without brittleness.

10. A component according to claim 9, wherein the component is from about 0.5 mm to about 3 mm thick.

11. A component according to claim 9, wherein the component has a thickness of 1.5 mm and a yield strength of 800 MPa and shaped for use as a car fender armature.

* * * * *